US006182919B1

(12) United States Patent
Fisher et al.

(10) Patent No.: US 6,182,919 B1
(45) Date of Patent: Feb. 6, 2001

(54) CONTACT ROLLER SYSTEM OF A WINDING MACHINE

(75) Inventors: Uwe Fisher, Gummersbach; Armin Hutzenlaub, Wiehl, both of (DE)

(73) Assignee: Kampf GmbH & Co. Maschinenfabrik, Wiehl (DE)

( * ) Notice: Under 35 U.S.C. 154(b), the term of this patent shall be extended for 0 days.

(21) Appl. No.: 09/381,532

(22) PCT Filed: Jan. 28, 1999

(86) PCT No.: PCT/EP99/00559

§ 371 Date: Sep. 17, 1999

§ 102(e) Date: Sep. 17, 1999

(87) PCT Pub. No.: WO99/41174

PCT Pub. Date: Aug. 19, 1999

(30) Foreign Application Priority Data

Feb. 11, 1998 (DE) ..... 198 05 412

(51) Int. Cl.[7] ..... B65H 18/26
(52) U.S. Cl. ..... 242/547; 242/541.5; 242/530.1
(58) Field of Search ..... 242/530.1, 530.3, 242/530.4, 541.5, 541.6, 547

(56) References Cited

U.S. PATENT DOCUMENTS 3,648,342 * 3/1972 Dorfel ..... 242/547
4,095,755 * 6/1978 Snygg et al. ..... 242/541.6
4,472,155 * 9/1984 Greding .
4,669,646 * 6/1987 Oinonen ..... 242/530.1 X
5,785,271 * 7/1998 Leskinen et al. ..... 242/530.1
5,806,783 * 9/1998 Turunen ..... 242/530.1

FOREIGN PATENT DOCUMENTS 26 32 608 2/1977 (DE) .
39 41 384 C1 6/1991 (DE) .
196 51 483 A1 10/1997 (DE) .
60-148861 6/1985 (JP) .

* cited by examiner

*Primary Examiner*—Donald P. Walsh
*Assistant Examiner*—William A. Rivera
(74) *Attorney, Agent, or Firm*—Herbert Dubno

(57) ABSTRACT

In winding machine for winding running webs of material, for instance paper webs or plastic foil, contact roller systems are known which have several roller segments arranged next to each other with their frontal sides, and which are supported to rotate freely and be perpendicularly movable with respect to their rotation axis. Each roller segment is held by a frame, which is supported to move perpendicularly to the rotation axis. Each frame of a roller segment comprises two lateral support plates extending parallelly to their frontal sides, whereby the neighboring support plates of two roller segments are arranged one above the other perpendicularly to the motion direction. The support plates can have deep annular grooves wherein the frontal faces of the roller segments can rotate free of touch.

12 Claims, 4 Drawing Sheets

CONTACT ROLLER SYSTEM OF A WINDING MACHINE

This application is a national stage of PCT/EP99/00559 filed Jan. 28, 1999 and based upon German national application 198 05 412.2 of Feb. 11, 1998 under the International Convention.

TECHNICAL FIELD

The invention relates to a contact roller system of a winding machine with several roller segments, arranged next to each other with their frontal sides and supported to rotate freely and to move perpendicularly with respect to their axis of rotation, and to a winding machine comprising the contact roller system for winding a running web of material, particularly a paper web or a plastic foil.

STATE OF THE ART

In winding machine which wind up running webs of material, for instance paper webs or plastic foil, it is known to use contact rollers as pressure or squeeze-off rollers, particularly at high speeds, mainly in order to prevent air from lodging in the winding roll.

If in the winding machine longitudinally subdivided webs of material are wound onto winding rolls which during winding are held by aligned winding tubes, then the contact rollers have to be individually movable for each winding roll, in order to compensate unavoidable differences in diameter. The axial length of a contact roller has thereby to be equal or bigger than the width of the winding roll against which it is pressed.

It is known to suspend contact rollers with a fixed length in individually movable bearings and to press them pneumatically against the respective winding roll. Contact rollers with fixed length can only cover a limited width area of winding rolls. When the winding width is changed outside their range, the contact rollers have to replaced with rollers having the appropriate length. Also the support locations have to be laterally displaced and positioned approximately centrally to the width of the respective winding roll. Therefore in order to operate a winding machine with very variable cutting widths, it is necessary to keep ready a large number of contact rollers. Besides each time the format is changed, the contact rollers have to be replaced and repositioned.

From German Patent 39 41 384 a winding machine with a generic contact roller system is known, wherein the roller segments as contact rollers are supported eccentrically next to each other without intervals on a support axle. As a result of the eccentric support, when commonly pressed against the winding roll each roller segment can move perpendicularly to its axis of rotation with respect to the adjacent roller segment. Furthermore through an interlocking of the roller segments, groups can be formed on the support axle. Although the individual roller segments can adjust their position in relation to the winding roll, it is not possible to press each individual roller segment against the winding roll with an individually adjusted contact pressure. This solution can not be applied in very wide machines, since the support axle lies inside the roller segments and its diameter is limited.

OBJECT OF THE INVENTION

The invention has the object to improve a generic contact roller system, so that each roller segment is individually adjustable in its position and its contact pressure, whereby the gap between two neighboring roller segments can be kept as small as possible in order to avoid marks.

SUMMARY OF THE INVENTION

This object is attained with a contact roller system for a winding machine having several roller segments arranged in succession along the winding roll and supported at their ends to rotate freely and to move perpendicular to the axis of rotation. Each roller segment is held in a respective frame for such movement and is supported by a pair of lateral support plates which extend parallel to these ends. The plates of neighboring roller segments are offset perpendicularly to this direction of movement to enable the ends of the neighboring roller segments to lie close to one another. According to the invention, narrow roller segments with individual pressure mechanisms can be arranged so close next to each other and controlled, so that together they take over the function of one contact roller with a length corresponding to the winding roll width. In the case of a format change, the contact rollers controlled by a computer can be automatically adjusted to a changed winding roll width. By arranging the support plates on top of each other the gap between two neighboring roller segments can be kept extremely small in order to avoid ring-shaped marks on the winding rolls during winding.

According to the invention, the inside of each support plate is provided with an annular groove in which the end of a respective roller segment can rotate without contact. The gap between neighboring roller segments is smaller than 5 mm and preferably ranges between 0.8 and 3 mm.

Each roller segment is supported by the respective frame on a cross bar which is common to all of the frames and roller segments and has a respective drive for moving the frame relative to the cross bar. Means can be provided for coupling neighboring roller segments to one another mechanically in order to form an inherently rigid roller. The axial clear space between the end of a roller segment and the rear wall of a respective annular groove can amount to 0.2 mm up to 5 mm, preferably approximately 3 mm.

The cross bar with the roller segments carried thereby can be set by a transverse motion to lie parallel to the rotation axis of the roller segments. The web which is wound up with the machine of the invention is preferably a paper web or plastic foil and the contact roller system is so constructed that the web running to the winding roll wraps around a roller segment through an angle of 50 to 30°.

BRIEF DESCRIPTION OF THE DRAWING

The drawing provides a basis for a more detailed explanation of the invention.

In the drawing.

SPECIFIC DESCRIPTION

Figure 1:
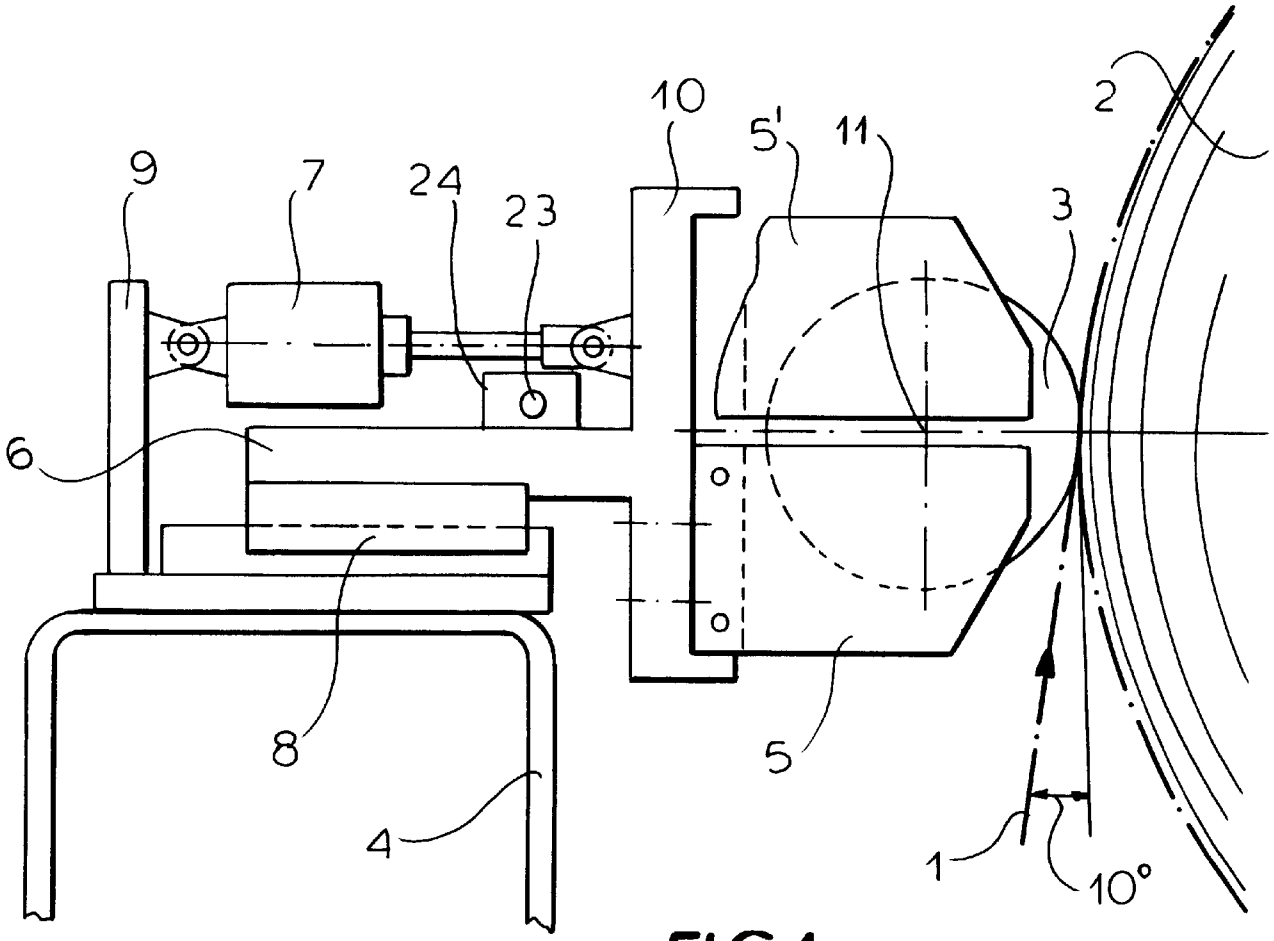
FIG. 1 is a side view of a contact roller system according to the invention.

The contact roller system is a component of a winding machine for winding running webs of material 1, particularly paper webs or plastic foil. The material webs 1 subdivided by longitudinal cuts are wound up on winding rolls 2, which are held in the winding machine by aligned winding tubes; the winding rolls 2 are either wound on a common winding axle, or each winding roll 2 is held by two grip heads which can be introduced into the winding tube. Particularly at high winding speeds it is necessary to provide contact rollers, in order to prevent air from lodging in the winding rolls.

The contact roller system comprises a row of roller segments 3 arranged next to one another, and whose axial lengths are smaller than the minimal width of a winding roll 2 to be wound up. In the embodiment example the length of each roll segment between 200 mm and 300 mm. Each roller segment 3 is individually movable perpendicularly to its rotation axis 11, on a crossbar 4 extending over the work width of the winding machine, and thereby supported so that it can be pressed against a winding roll 2 and unavoidable differences in the diameters of the winding rolls 2 can be compensated.

Figure 3:
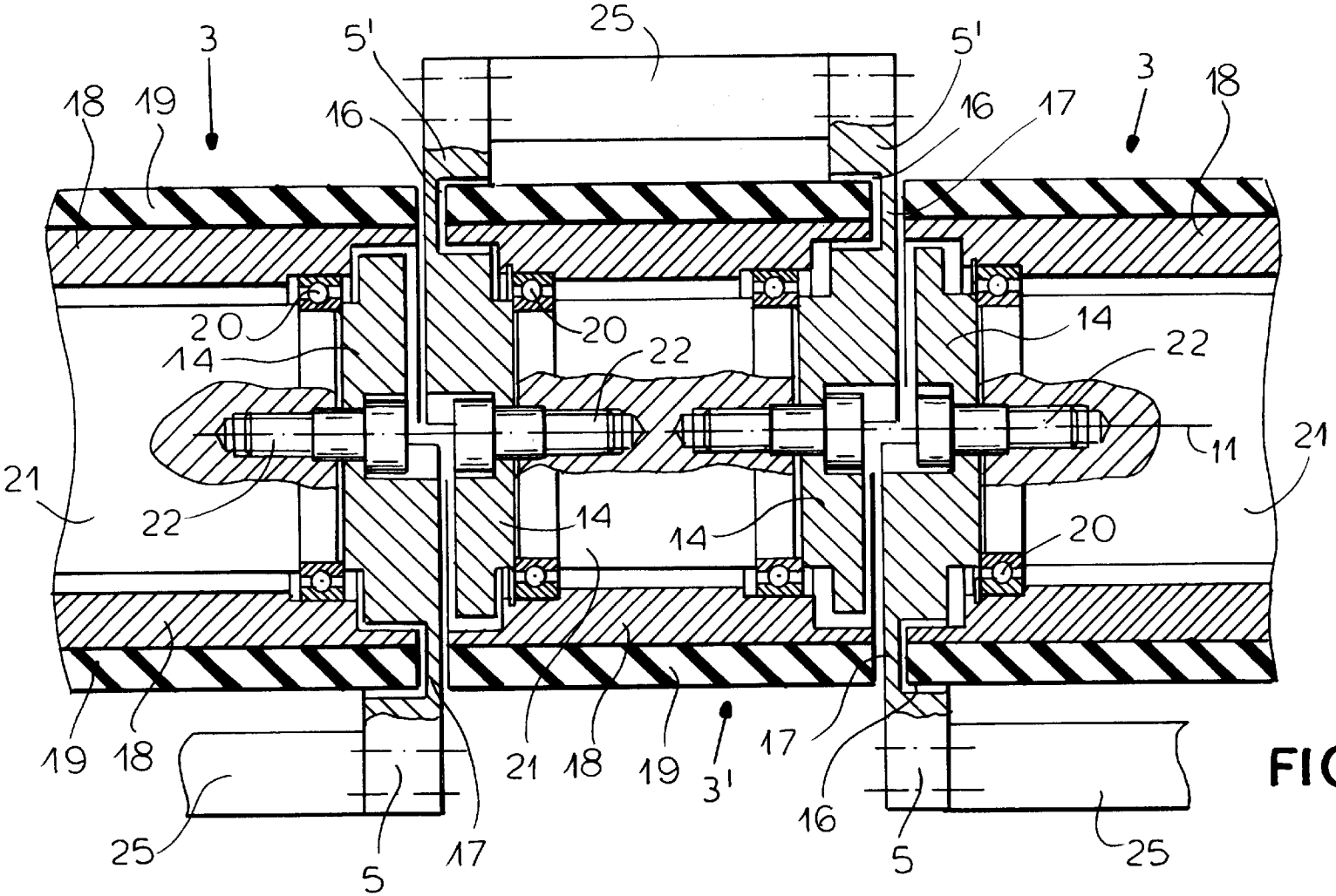

In order to make possible the individual setting of the position and contact pressure, each roller segment 3 is supported at its ends to be freely rotatable by two lateral support plates 5, which extend parall to the ends of the roller segments 3. The plates are each connected on the side facing away from the contact point with the winding roll 2 to a rigid frame, by means of a transverse plate 25 (FIG. 3). Each plate 25 forms part of a carriage 6 movably supported on the crossbar 4 in a linear guide 8, preferably in a spherical guide, so that it can move towards and away from the winding roll 2, e.g. perpendicularly with respect to the rotation axis 11. The drive for the sliding motion is a pneumatic piston-cylinder unit 7, which is mounted on the one side on a support plate 9 fastened to the crossbar 4, and on the other side to a fork-like support part 10 of the carriage 6, on which the transverse plate 25 of the frame of a roller segment 3 is suspended. The carriages 6 are designed to be smaller than a roller segment 3, so that for each roller segment 3 a carriage 6 can be mounted on the crossbar 4.

In order to keep the gap between two neighboring roller segments 3 as narrow as possible, the lateral support plates 5 of two neighboring roller segments 3 are arranged alternately underneath and above the rotation axis 11. This makes it possible to arrange the two required support plates 5 between two roller segments 3 one on top of the other perpendicularly to the sliding direction of the carriage 6, as shown in FIG. 1. There the position of the lateral support plate 5' of the neighboring roller segment 3' is also represented.

Figure 4:
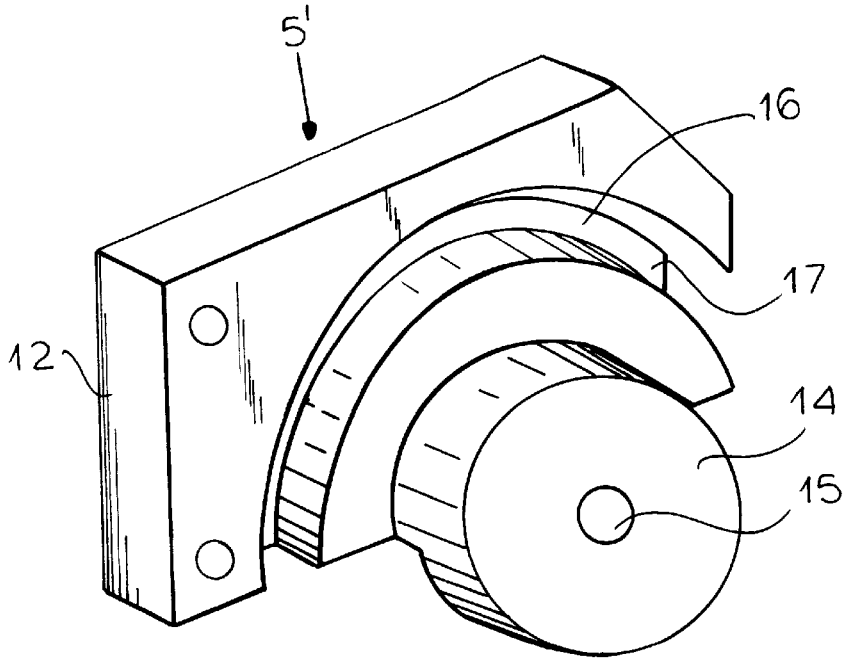
FIGS. 4 and 5 show the lateral support plates of a roller segment in perspective view.
Figure 5:
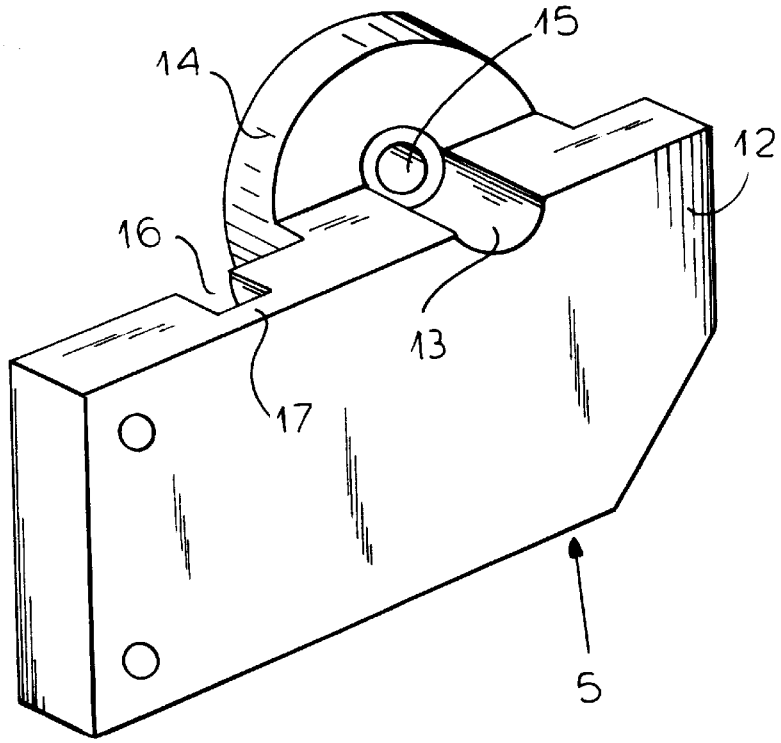

The construction of a lateral support plate 5 is shown in perspective in FIGS. 4 and 5. Preferably the support plates 5 are designed identically so that they can be used for mounting above the axis of rotation 11 (FIG. 4, as well as for mounting under the axis of rotation 11 (FIG. 5).

Each support plate 5 consists of a plate-like part 12, in whose one longitudinal edge a transverse groove with a semicircular cross section is provided for receiving the head of a fastening screw 22 FIG. 3. On one side of the part 12, a disk-like axle support 14 with a central passage bore 15 is fastened, for instance flatly soldered on, or made in one piece 5, 5' with the plate-like part 12. The central passage bore 15 is aligned with the groove 13. Concentrically around the axle support 14, on the inner side of the part 12 an annular groove 16 is wrought in, whose curvature and size are selected so that the correspondingly shaped end of a roller segment 3 can rotate free of contact in the annular groove 16. The rear wall 17 of the part 12 remaining at the bottom of the groove 16 is designed to be extremely thin, since it defines the minimal distance between two neighboring roller segments 3. Preferably the thickness of the rear wall 17 amounts to 1 mm or less. In spite of the reduced thickness, the required strength for supporting a roller segment 3 is provided, since the part 12 is thicker in its remaining area and the annular rear wall 17 does not have a straight flexion line.

On the side opposite to the fastening end—on the right in FIGS. 4 and 5—the plate-shaped part 12 is shortened, the annular groove 16 being this way somewhat shortened with respect to a half circle. This leads to the fact that in this area an inserted roller segment 3 projects peripherally beyond the area of the plate-shaped part 12, as shown in FIG. 1. This way the area of the contact point to the winding roll 2 is kept clear. A web of material 1 running towards the winding roll 2 can touch first a roller segment 3 and then the winding roll 2. This has effective technological advantages. Through a corresponding bevelling of the parts 12 on their side facing a winding roll 2, the wrapping angle of the web 1 about the a roller segment 3 can be set in the desired area, independently of the upper of lower mounting and of the winding direction, to be symmetrical for both possible winding directions. The wrapping angle of the web 1 about a roller segment 3 amounts from 5° to 30°, preferably between 80 and 20°, in order to prevent the escape of the air layer coming on with the web 1.

As can be seen from FIG. 3, each roller segment 3, 3' consists of a roller sleeve 18, preferably made of metal, to which an outer running layer 19 made of rubber is applied. The roller sleeve 18 is mounted freely rotatable on an axle 21 via two lateral roller bearings 20. At each lateral end it is graduated in such a manner that during assembly the end dips without contact into the annular groove 16 of the support plate 5, 5'. The assembly takes place so that the axial free space between the frontal faces of a roller segment and the rear wall 17 in the annular groove 16 amounts to 0.2 mm to 5 mm, preferably to approximately 3 mm.

Each axle 21 is screwed onto both ends by means of screws 22 on the plate-like axle bearer 14 of the support plate 5, 5'. The screws 22 extend each from the outside centered with respect to the rotation axis 11, through the bore 15 of the axle bearer 14, whereby their head is partially sunk in the transverse groove 13 of the plate-shaped part 12. The support plate 5, 5' of two neighboring roller segments 3, 3' are fastened alternately on the top or at the bottom on the fork-like support part 10 of the carriage 6. In FIG. 3 the support plates 5 of the two outer roller segments 3 are arranged at the bottom, the support plates 5' of the middle part on top. The support plates 5' of the middle roller segment 3 are flipped upwards by 180° about the axis of rotation 11, for the sake of a clearer representation. In the mounted position, the rear walls 17 of the support plate 5' of the middle roller segment 3' lie precisely on the corresponding rear walls 17 of the support plates 5 of the outer roller segments 3. The two support plates 5, 5' bearing the axles 21 of two neighboring roller segments 3, 3' are therefore arranged in the space between the neighboring roller segments 3, 3' mutually slidable one on top of the other and perpendicularly to the rotation axis 11. The arrangement of the support plates 5, 5' one above the other makes it possible to keep the required gap between two neighboring roller segments 3, 3' very small. In order to prevent marks on sensitive webs 1, the gap measures less than 5 mm, preferably between 0.8 mm and 3 mm.

According to a preferred embodiment, two neighboring roller segments 3, 3' can be coupled mechanically in such a manner that their rotation axes 11 are precisely aligned. The coupled roller segments 3. 3' form an inherent rigidly pressure roller, which is pressed with the same pressure against a winding roll 2. The contact line of all intercoupled roller segments 3, 3' forms an accurate straight line. A coupling of two neighboring roller segments 3, 3' is advantageous when, due to high thickness tolerances, winding rolls 2 are wound with zones of very different winding roll diameters. Then it is not desirable that each roller segment 3, 3' pressing against the winding roll 2 be adjusted to the actual diameter in its application zone. Also the coupling of two neighboring roller segments 3, 3' can be advantageous when a roller segment 3, 3' projects with excessive axial length beyond the winding roll 2.

Figure 2:
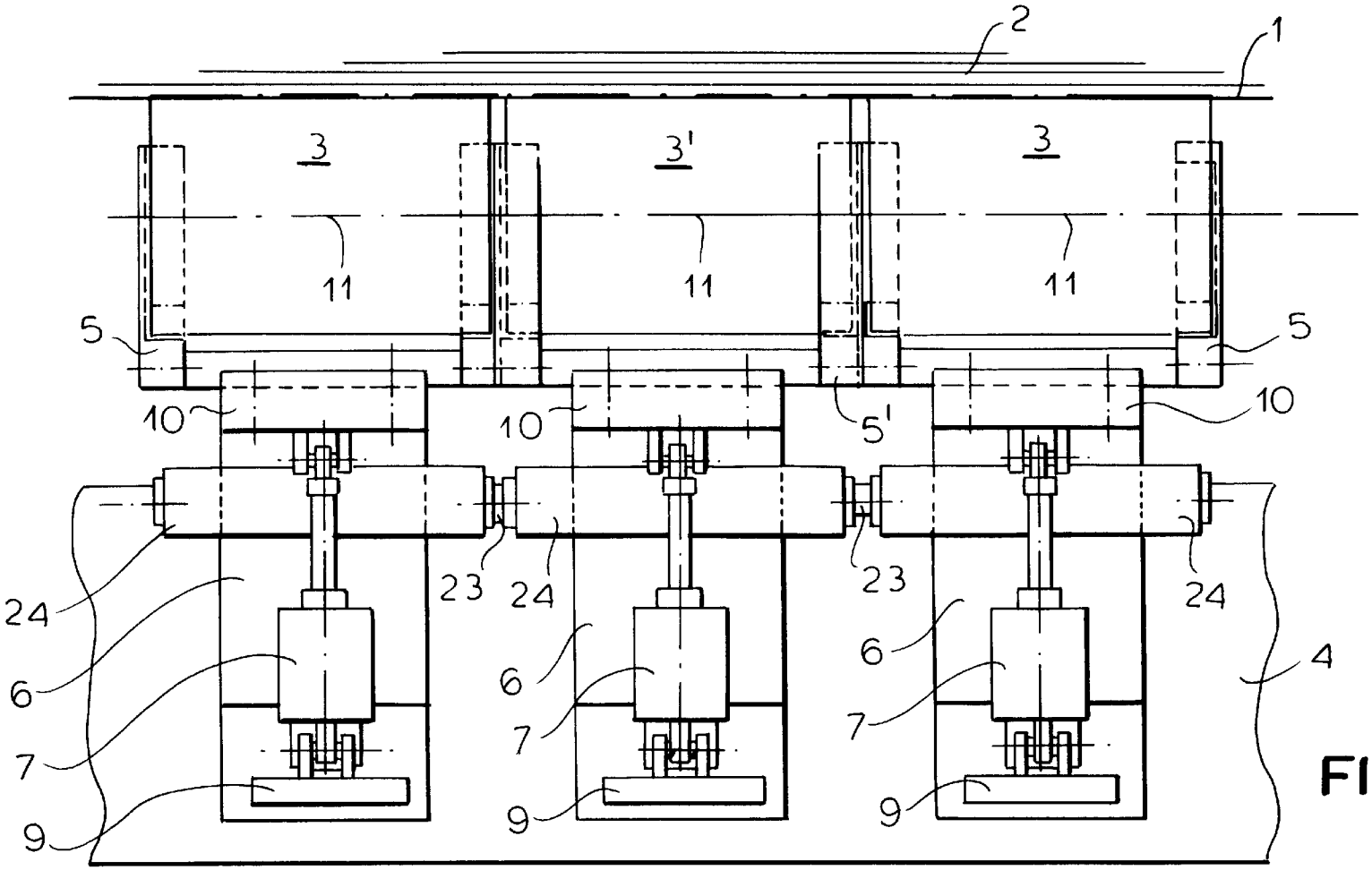
FIG. 2 is a top view of a contact roller system according to, FIG. 3 is a detail in cross section.

As coupling elements preferably sliding bolts 23 are used as shown in FIGS. 1 and 2—fastened on the carriage 6 to be movable parallel to the rotation axis 11. The bolts 23 supported in a guide 24 can be moved back and forth in their axial direction—for instance by means of magnets or pneumatic cylinders—and for the purpose of coupling move with their end into a corresponding opening in the guide 24 of the neighboring carriage 6.

In extremely sensitive materials, for instance foils with a thickness of less than 10 $\mu$m, even very narrow gaps between two neighboring roller segments 3 can lead to circular marks on the winding roll 2. In order to avoid such marks, in an advantageous embodiment the crossbar 4 with the roller segment 3 fastened thereto can be moved back and forth over a minimal stroke transversely to the travel direction of the web, i.e. parallel to the orientation of the roller segment 3. During winding the crossbar 4 is set into a traverse motion, so that the position of the gap between two neighboring roller segments 3 is permanently changed. Preferably the traverse motion is performed with a stroke of approximately 10 mm in both directions from the initial position.

During winding for each winding roll 2 the roller segments 3 in its width range are coupled together to form one contact roller of the required axial length, without requiring a displacement of the roller segments 3 in axial direction or a replacement of contact rollers adjusted to the respective winding roll width. All roller segments 3 which are not required are automatically moved into an end position. In case of a format change, correspondingly modified groups of roller segments 3 are activated. If required, neighboring and active roller segments 3 are coupled together by means of the slidable bolts 23 to form an inherently rigid contact roller with a precisely straight contact line. The contact rollers intercoupled this way are pressed against the winding roll 2 with an adjustable pressure, in order to extensively prevent the entering of air in the winding rolls.

What is claimed is:

1. A contact roller system for a winding machine having at least one winding roll on which a web is to be wound, said contact roller system comprising:

a plurality of contact roller segments juxtaposed with said winding roll and arrayed along said winding roll, said contact roller segments pressing said web against said at least one winding roll and having respective ends, with the ends of neighboring pairs of said contact roller segments facing each other;

a respective frame carrying each of said contact roller segments and movable in a direction perpendicular to the respective contact roller segment for displacing the respective contact roller segment toward said at least one winding roll; and two lateral support plates on each of said frames, extending parallel to ends of a respective contact roller segment and engaging respective said ends of the respective contact roller segment to support the respective contact roller segment for free rotation on the respective frame, the support plates of each contact roller segment being offset from the support plates of the neighboring contact roller segments perpendicularly to said direction.

2. The contact roller system defined in claim 1 wherein an inside of each of said support plates is provided with an annular groove receiving an end of a respective roller segment rotatably without contact.

3. The contact roller system defined in claim 2 wherein said roller segments have gaps between them which are smaller than 5 mm.

4. The contact roller system as defined in claim 3 wherein said gaps range between 0.8 mm and 3 mm.

5. The contact roller system as defined in claim 2 further comprising a common cross bar supporting all of said frames, each of said frame being shiftable in said direction relative to said cross bar by a respective drive.

6. The contact roller system as defined in claim 5 further comprising means for displacing said cross bar to set said cross bar parallel to a rotation axis of a respective roller segment.

7. The contact roller system as defined in claim 2 further comprising means for coupling neighboring roller segments to each other mechanically to form an inherently rigid pressure roller.

8. The contact roller system as defined in claim 2 wherein each of said ends is axially spaced from a rear wall of the respective groove by 0.2 mm to 5 mm.

9. The contact roller system as defined in claim 8 wherein the distance between each rear wall and the respective end of a roller segment received in the respective groove is approximately 3 mm.

10. The contact roller system as defined in claim 1 wherein said winding machine is a machine for winding a paper web or plastic foil.

11. The contact roller system as defined in claim 10 wherein said contact roller segments are so positioned that a web running to said winding roll wraps around a roller segment through an angle of 5° to 30°.

12. The contact roller system as defined in claim 11 wherein said angle is between 8° and 20°.

* * * * *